United States Patent [19]

Ryder

[11] Patent Number: 5,008,048

[45] Date of Patent: Apr. 16, 1991

[54] POSITION INSENSITIVE ASPIRATOR

[76] Inventor: Steven L. Ryder, 1334 Woodcrest, Fullerton, Calif. 92633

[21] Appl. No.: 493,888

[22] Filed: Mar. 15, 1990

Related U.S. Application Data

[63] Continuation-in-part of Ser. No. 279,657, Dec. 5, 1988, abandoned, and a continuation-in-part of Ser. No. 415,914, Oct. 2, 1989.

[51] Int. Cl.[5] ..... B01F 3/04

[52] U.S. Cl. ..... 261/78.2; 239/342; 239/338; 239/346; 261/DIG. 65

[58] Field of Search ..... 261/78.2, DIG. 65; 239/342, 338, 346

[56] References Cited

U.S. PATENT DOCUMENTS

| | | | |
|---|---|---|---|
| 382,156 | 5/1888 | Hanford . | |
| 2,196,800 | 4/1940 | Krantzberger | 239/342 |
| 2,724,583 | 11/1955 | Targosh et al. | 261/78.2 |
| 2,966,312 | 12/1960 | Wilson, Jr. et al. . | |
| 2,993,652 | 7/1961 | Curry . | |
| 3,172,406 | 4/1962 | Bird et al. . | |
| 3,498,028 | 3/1970 | Trouw . | |
| 3,515,676 | 6/1970 | Hierta et al. | 261/78.2 |
| 3,605,388 | 7/1972 | Zuiderweg et al. . | |
| 3,999,713 | 12/1976 | Lindsey . | |
| 4,206,160 | 6/1980 | Suddendorf et al. . | |
| 4,231,973 | 11/1980 | Young et al. | 261/78.2 |
| 4,251,033 | 2/1981 | Rich et al. . | |
| 4,261,511 | 4/1981 | Erb et al. | 239/338 |
| 4,284,590 | 8/1981 | DeBoer, Jr. et al. | 239/338 |
| 4,512,341 | 4/1985 | Lester | 239/338 |
| 4,560,519 | 12/1985 | Cerny | 261/78.2 |
| 4,566,452 | 1/1986 | Farr . | |
| 4,746,067 | 5/1988 | Svoboda | 239/338 |

FOREIGN PATENT DOCUMENTS 64631 6/1913 Switzerland .

*Primary Examiner*—Tim Miles

*Attorney, Agent, or Firm*—Plante Strauss Vanderburgh and Connors

[57] ABSTRACT

A device for aspirating liquids which is operable from any position or orientation includes a hollow housing which communicates with a source of carrier gas and a source of gas under pressure. A nozzle is disposed within the hollow housing through which the pressurized gas is directed to produce a high speed stream of gas. An entrainment member defining an aspiration chamber for the liquid is disposed in the housing with the aspiration chamber immediately adjacent to the nozzle outlet in the housing. A multi-directional liquid flow path communicating between the housing interior and the aspiration chamber is defined by the entrainment member and the edges thereof to provide fluid communication between the aspiration chamber and any point in the housing regardless of the orientation of the device.

18 Claims, 7 Drawing Sheets

POSITION INSENSITIVE ASPIRATOR

CROSS REFERENCE TO OTHER APPLICATIONS

This application is a continuation-in-part of application Ser. No. 279,657, filed Dec. 5, 1988 for POSITION INSENSITIVE ASPIRATOR and application Ser. No. 415,914, filed Oct. 2, 1989 for POSITION INSENSITIVE NEBULIZER.

FIELD OF THE INVENTION

This invention relates to aspirating liquids in gaseous media and, more particularly, to apparatus for aspirating a liquid and for diffusing the aspirated liquid in a carrier gas.

BACKGROUND OF THE INVENTION

One of the significant problems characterizing the prior art involving aspirators and nebulizers is that such devices are positionally sensitive. For example nebulizers, which aspirate a liquid, such as a medicinal liquid, and dispense it as a mist or aerosol in a carrier gas for inhalation by a patient, are positionally sensitive. In order for such nebulizers to properly operate, the nebulizer must be oriented in such a way as to permit the liquid to be drawn to the nozzle for aspiration. However, should the patient move in a manner so as to change the orientation of the nebulizer, aspiration may be terminated due to the fact that the liquid is not drawn into proximity with the nozzle for aspiration. In such a case, the liquid is not properly delivered to the patient. To avoid this problem the nebulizer is usually placed away from the patient. Accordingly, a relatively long delivery tube between the nebulizer and the patient is required and may produce a condition which may result in some of the aspirated liquid condensing in the delivery tube.

In other situations, such as in the case of devices for spraying various liquids such as paint, herbicides, pesticides and the like, the working position of the sprayer is such as to prevent the proper drawing of the liquid to the aspiration chamber of the sprayer or, as the sprayer reservoir is depleted the negative pressure within the sprayer is broken resulting in little or no aspiration and the waste of a significant portion of the liquid remaining in the sprayer reservoir.

SUMMARY OF THE INVENTION

The present invention relates to a new and improved device for aspirating liquids which is operable from any position or orientation. When utilized as a nebulizer, the device of the present invention ensures the formation of an aerosol and the proper pulmonary delivery of medication to the patient. The device of the present invention eliminates the need for any substantial run or length of tubing between the device and the patient, thereby substantially eliminating condensation or "rain" prior to delivery of the medication to the patient. Moreover, the device of the present invention eliminates the danger of administering liquid directly to the patient's lungs even should the device be used for patients who are unconscious or asleep and who may move while in this condition thereby inadvertently repositioning the nebulizer. When utilized as an ordinary spray device, the device of the present invention permits the spraying of an object from essentially any sprayer position.

The device of the present invention includes a hollow housing which communicates with a source of carrier gas and a source of gas under pressure. A nozzle is disposed within the hollow housing through which the pressurized gas is directed to produce a high speed stream of gas which reduces pressure within the housing. Liquid to be aspirated is drawn from the housing to a point immediately adjacent the nozzle where it enters the high pressure stream and is aspirated. If utilized as a nebulizer or similar aspirating device, the aspirated liquid is mixed with the carrier gas and exits the housing. When utilized as a spraying device, the carrier gas and high pressure gas are one and the same and the aspirated liquid is directed out of the nozzle under the high pressure of the pressurized gas.

In accordance with one embodiment of the invention, an entrainment member defining an aspiration chamber is disposed in the housing with the aspiration chamber immediately adjacent to the nozzle outlet in the housing. An omnidirectional liquid flow path communicating between the reservoir and the aspiration chamber is defined by the entrainment member and the edges thereof to provide fluid communication between the aspiration chamber and any point in the reservoir regardless of the orientation of the device.

In one embodiment of the invention, the entrainment member is provided with a plurality of spaced channels which open at the peripheral edges of the entrainment member and extend through the member to the aspiration chamber. The peripheral edges of the entrainment member are spaced inwardly from the side walls of the housing to provide fluid communication from the reservoir to the openings of the channels at the periphery of the entrainment member.

In another embodiment of the invention, the entrainment member is disposed proximate an end wall of the housing and is spaced therefrom to provide a liquid flow path between the opposing surfaces of the housing end wall and the entrainment member. Fluid communication to the reservoir is completed by spacing the edges of the entrainment member inwardly from the side walls as described above.

In yet another embodiment of the invention, the entrainment member is disposed with a surface contiguous with an end wall of the housing and the edges spaced inwardly as described. A plurality of open channels are provided along the surface of the entrainment member and extend from the periphery to the central aperture thereof. The entrainment member defines the side and bottom walls of the channel and the channel is closed by the opposing end wall surface.

In still yet another embodiment of the invention the entrainment member comprises a central hollow hub, an outer rim defining a wall surface configured to fit in the housing adjacent the inner wall surface of the housing to define a fluid path therebetween, and at least a pair of opposed hollow arms connecting the central hollow hub and the rim. The hollow arms open to the outer wall surface of the rim and define a flow path from the rim to the central hub.

In accordance with the invention, liquid in the reservoir is drawn toward the aspiration chamber in response to reduced pressure in the housing along any of the liquid flow paths defined by the entrainment member. Communication between the reservoir and the aspiration chamber is provided from essentially any part of the reservoir so that the position or orientation of the device is immaterial. Aspiration occurs in the aspiration chamber by the action of the high speed stream of pressurized gas on the liquid in conventionally known fashion. Thus, the device of the present invention may incorporate any of the commonly known nozzle arrangements and may further include baffles of various designs to even more finely divide the liquid particles.

The device of the present invention is operable from any position and finds application in any situation where liquid is to be aspirated such as for example, nebulizers and other devices for inhalation therapy and pulmonary delivery of medication.

Other features and advantages of the invention will become apparent upon reference to the specification taken in conjunction with the drawings in which like elements are referred to by like reference characters throughout the several views.

DESCRIPTION OF THE PREFERRED EMBODIMENTS

As briefly outlined above, the device of the present invention is an aspirator which is functional from essentially any position or orientation. This is extremely important in the case of nebulizers which are utilized in hospitals for inhalation therapy and for the pulmonary delivery of medications. As mentioned, with the prior art aspirators, the orientation of the aspirator is critical in order to ensure the continuous delivery of the liquid being aspirated to the patient and to prevent patient discomfort, or even suffocation, due to inhalation of unaspirated liquid which can occur when the aspirator is not positioned properly or is too remote from the patient. The invention will be described hereinafter primarily in connection with its use as a nebulizer. However, it will be apparent that the principles of operation are applicable to uses of the device in areas other than as a delivery system for medication.

Figure 1:
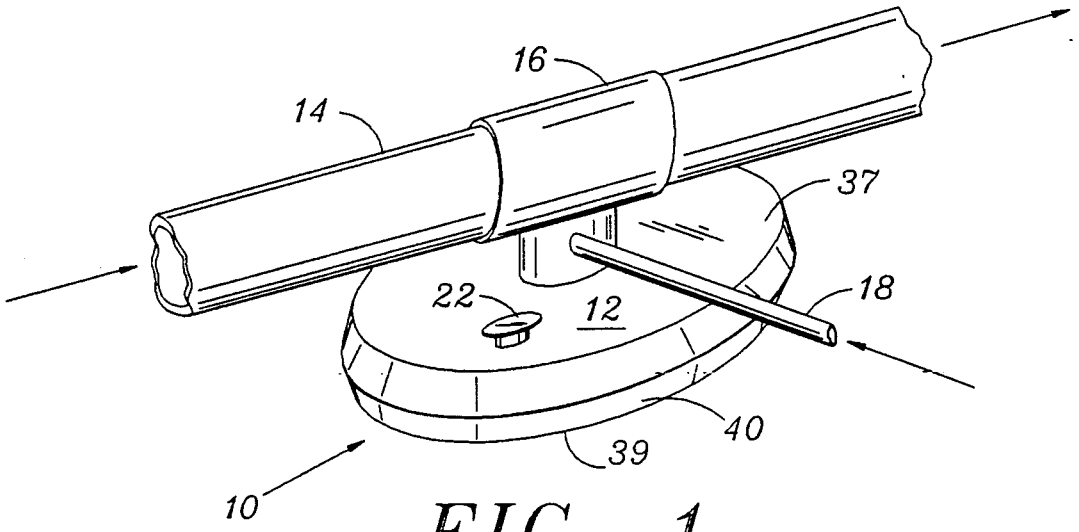
FIG. 1 is a perspective view of the device of the present invention employed as a nebulizer and connected to a carrier gas line in a "side stream" arrangement.

Referring to the drawings, FIG. 1 illustrates a device, shown generally as 10, consisting of a hollow housing 12 of generally circular or cylindrical configuration having facing walls 37 and 39 and side wall 40. The interior of the housing 12 defines a liquid reservoir 13. The device 10 which is adapted for connection in a side stream arrangement with a carrier gas line 14 by a T-member 16 which provides communication between the interior of the housing 12 and the carrier gas line 14. As is conventional, the carrier gas may be ordinary air which is circulated under slight positive pressure. An adapter (not shown) such as a breathing mask, mouth piece, airway or the like is provided to deliver the carrier gas from the line 14 to the patient. A smaller high pressure line 18 also communicates with the T-member 16 for the introduction of a high speed stream of gas, such as oxygen, for creating a reduced pressure in the housing 12 and for aspirating a liquid as is conventional with aspirators of the prior art. Preferably an opening 20 and removable plug 22 are provided in the housing 12 for the addition of liquid to be aspirated into the reservoir 13 However, the opening 20 and removable plug 22 may be eliminated and the liquid to be aspirated may be introduced into the reservoir 13 through the T-member 22 or the carrier gas line 14. If larger amounts of liquid are to be aspirated, a connector and line to an external source of liquid (not shown) to maintain a prescribed level of fluid in the reservoir 13 may be substituted for the plug 22.

Figure 2:
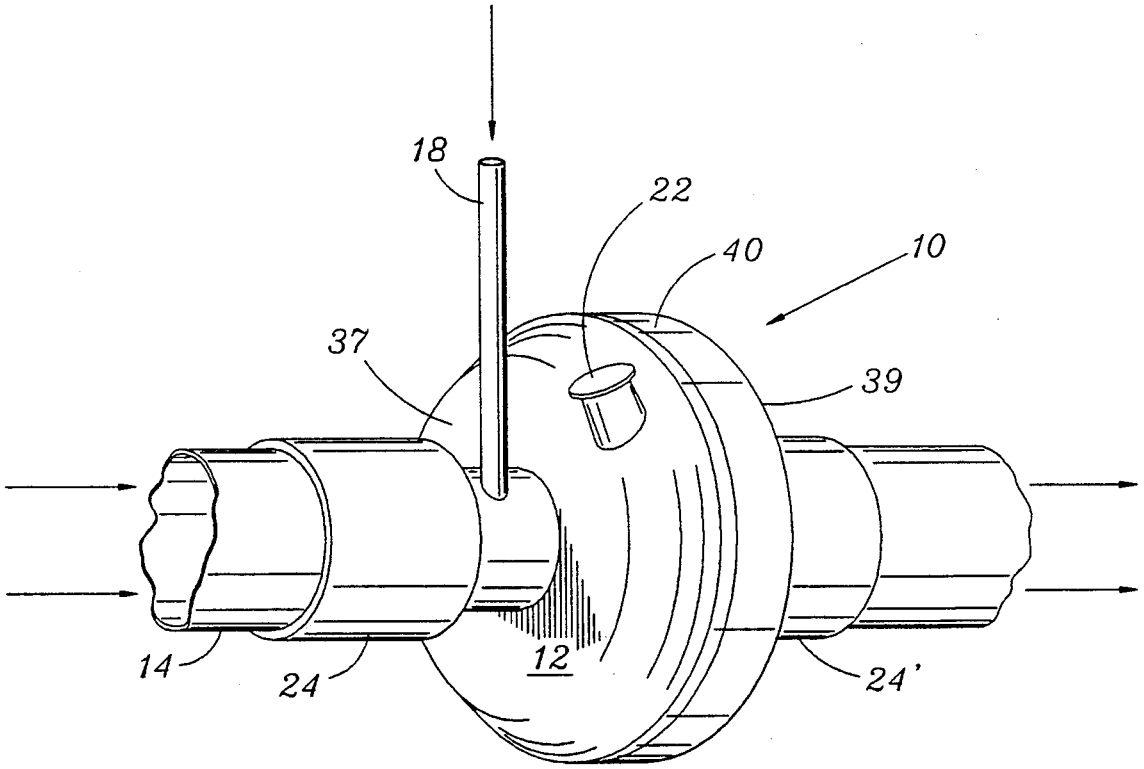
FIG. 2 is a perspective view of the device of the present invention employed as a nebulizer and connected in a line for carrier gas in a "main stream" arrangement.
Figure 3:
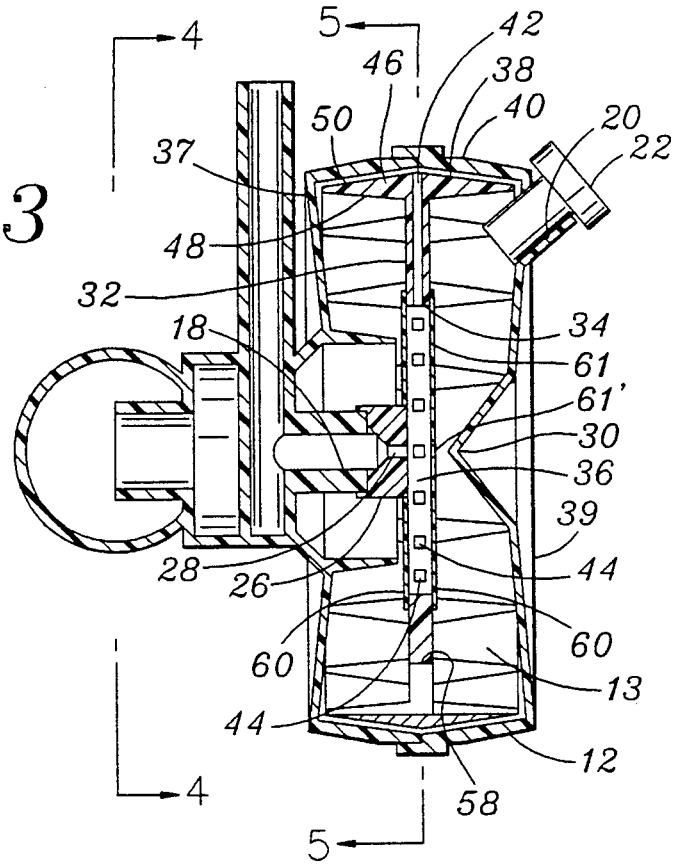
FIG. 3 is a side sectional view of the device of FIG. 1.
Figure 4:
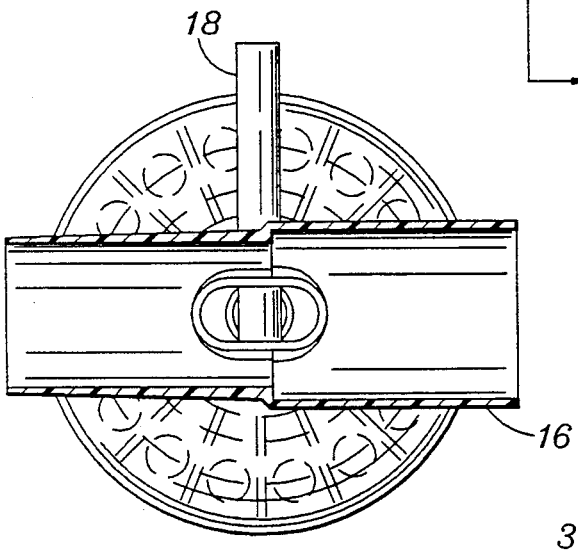
FIG. 4 is a top sectional view along line 4—4 of FIG. 3.
Figure 5:
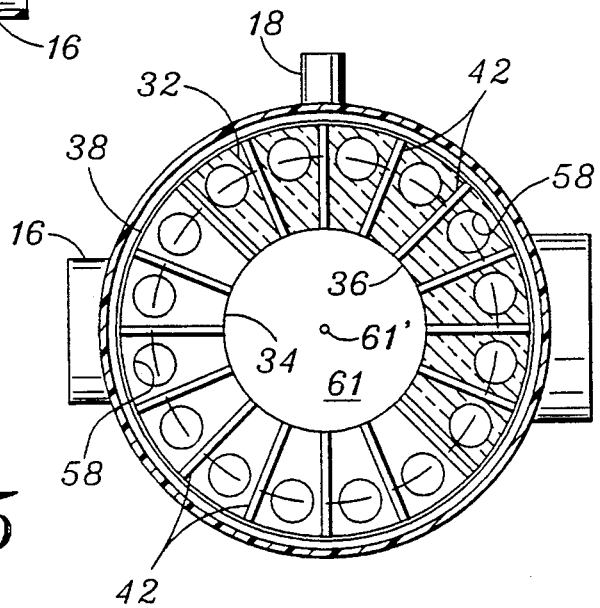
FIG. 5 is a sectional view taken along line 5—5 of FIG. 3.
Figure 6:
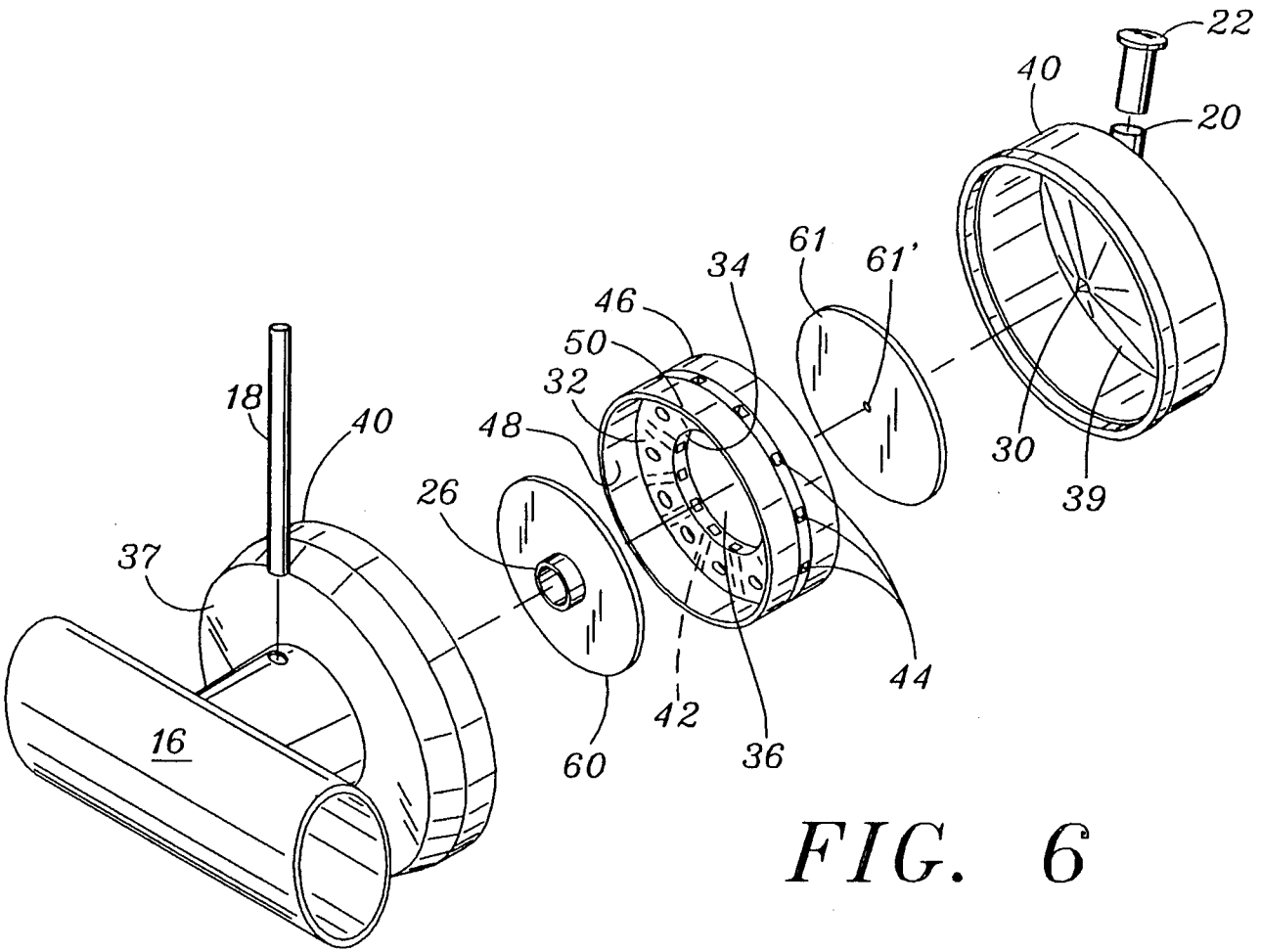
FIG. 6 is an exploded perspective view of the device of FIG. 1.

In FIG. 2 the device 10 is illustrated in a main stream arrangement in which the carrier gas line 14 communicates directly with the interior of the housing 12 through an in-line connector 24 which is also adapted to communicate with the high pressure line 18. The particular arrangement, be it side stream or main line, is a matter of choice and except for the obvious modifications of the connector members 16 and 24, the operation of the device is essentially unaffected by its manner of connection to the carrier gas line 14.

As is more clearly shown in FIGS. 3, 4, 5 and 6, a nozzle 26 is disposed in the interior of the housing 12 so that the inlet to the restricted nozzle bore 28 is in general alignment with the outlet of the high pressure line 18. A baffle 30 is aligned with the orifice of the nozzle 26 to even further subdivide the liquid droplets aspirated at the nozzle to form an aerosol for delivery to the patient in the manner to be described hereinafter.

In accordance with the invention an entrainment member 32 having a central aperture 34 is disposed in the housing 12 so that the aperture 34 is in communication with the orifice of the nozzle 26 to define an aspiration chamber 36. The edges 38 of the entrainment member 32 are spaced inwardly from the sidewalls 40 of the housing 12 and entrainment ducts 42 extend through the body of the entrainment member 32 and open at the periphery and the central aperture 34 of the member 32 to define entrainment ports 44. As illustrated in FIGS. 3–6, the entrainment member 32 is a generally flattened washer-shaped member having a plurality of openings 58 for fluid communication through the member 32. As illustrated, the edges of the entrainment member 32 are configured to define an annular collar 46 having an inner face 48 and an outer face 50. The inner face 48 of the collar 46 is biased away from member 32 so that liquid in the reservoir 13 will tend to collect in an area adjacent an edge of the collar and the housing sidewall.

The entrainment member 32 is retained in its proper position in the housing 12 by a plate 60 which also carries the nozzle 26. A second plate 61 having a small central opening 61' is positioned on the opposite side of the entrainment member 32 and both the plates 60 and 61 overlie the central aperture 34 and to secure the entrainment member 32 within the housing 12. The opening 61' is aligned with the orifice of the bore 28 of the nozzle 26. The inner faces of the plates 60 and 61 cooperate with the edges of the entrainment member 32 at the central aperture 34 to complete the definition of an aspiration chamber 36.

In operation a pressurized gas enters the housing 12 through the high pressure line 18 and thence to the nozzle 26 where it is forced through the nozzle bore 28 to form a high speed gas stream. The high speed gas stream produces a low pressure in the housing 12. Liquid contained in the housing 12 is entrained in the liquid flow path defined by the side walls 40 of the housing 12 and the outer face 50 of the collar 46 and flows to one or more of the entrainment ports 44 defined at the peripheral edge of the entrainment member 32 and thence through one or more of the ducts 42 to exit at a corresponding entrainment port 44 in the aspiration chamber 36. At this point, the fluid contacts the high speed stream of gas where it is aspirated and is carried in the high speed stream through the aperture 61' in the plate 61. The high speed stream carrying liquid impinges the baffle 30 where the liquid droplets are more finely divided. The baffle also serves to distribute the high speed stream of gas causing it to flow in a reverse direction through the openings 58 in the entrainment member 32 and thence to exit the housing 12 through the T-member 16 to the carrier gas line 14 to the patient. As can be seen, the flow path communicates with the reservoir 13 around the entire periphery of the entrainment member 32. The substantially large number of entrainment ports 44 at the peripheral edge of the entrainment member 32 ensure that regardless of the position of the device 10 there is an open flow path between the interior of the housing 12 and the aspiration chamber 36. The inner face 48 of the collar is configured so as to direct any liquid in the reservoir 13 to the opening of the liquid flow path between the housing side walls 40 and the outer face 50 of the collar 46. In this manner, even slight amounts of liquid remaining in the reservoir 13 are entrained and moved to the aspiration chamber regardless of the orientation of the device 10.

Figure 7:
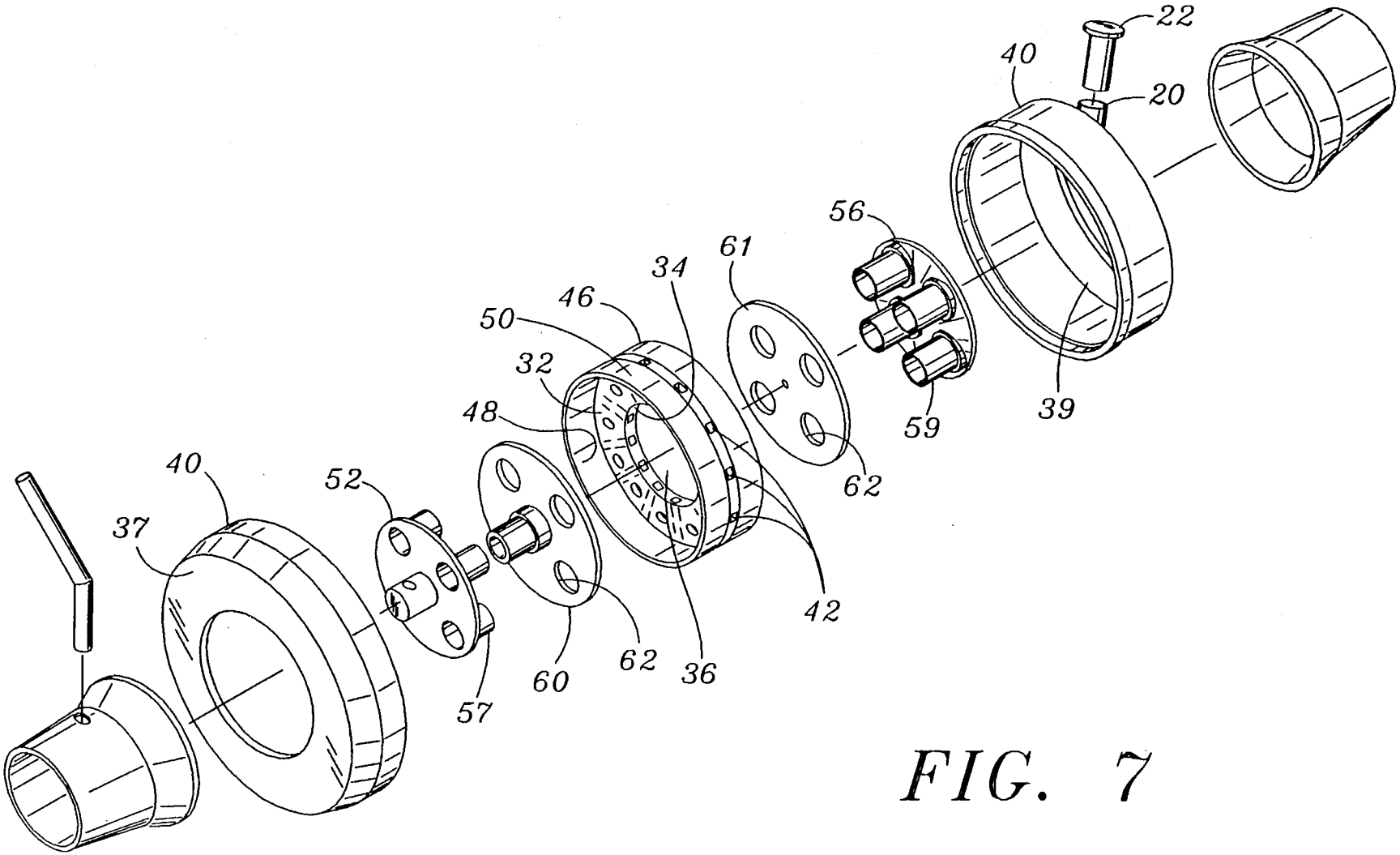
FIG. 7 is an exploded perspective view of the device of FIG. 2.
Figure 8:
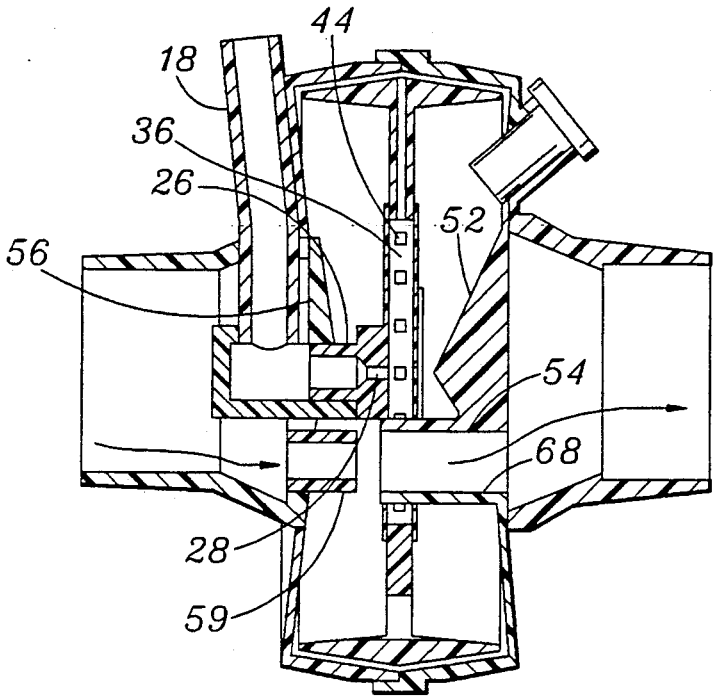
FIG. 8 is a side sectional view of the entrainment member of FIG. 7.

The operation of the device 10 in the mainstream arrangement (FIG. 2) is essentially the same as for that described above except that the carrier gas is permitted to flow through the interior of the housing 12. As is more specifically shown in FIGS. 7 and 8 where like parts have like function and like reference numbers, the carrier gas flows through the housing 12 through passages 64 which are formed by a male retaining disk 52 with open ended tubular members 54 which are received in cylindrical sockets 59 of a female retainer disk 56. The plates 60 and 61 are also provided with openings 62 through which extend the corresponding tubular members 54 and the sockets 59 to define the passages 64 when joined. In this fashion, the carrier gas is isolated from the interior of the housing 12 and does not interfere with the aspiration of the liquid therein. The aspirated liquid is then dispersed into the carrier gas and transported therein to the patient.

Under certain circumstances it may be desirable to reduce the dimensions of the device 10, such as for example, by reducing the thickness of the housing 12. In one embodiment of the invention, this is accomplished by eliminating the collar 46 while retaining the edge of the retainer member 32 in spaced relationship to the inner wall of the housing 12. Thus the liquid flow path is from the reservoir 13 through the space defined between the housing side wall 40 and the edge of the retainer member 32 to one or more of the entrainment ports 44. The functioning of the device from any position is as was described above in connection with FIGS. 1–8.

Figure 9:
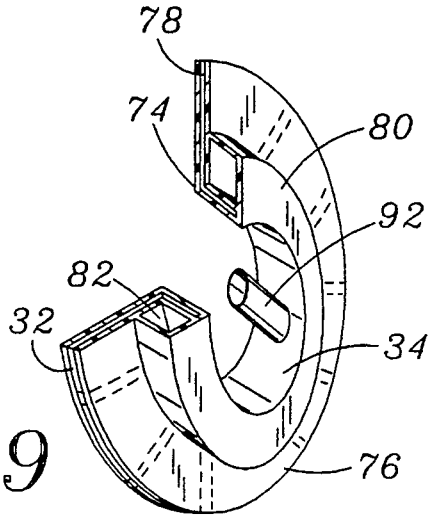
FIG. 9 is a perspective view, partially in section, of another embodiment of an entrainment member in accordance with the present invention.
Figure 10:
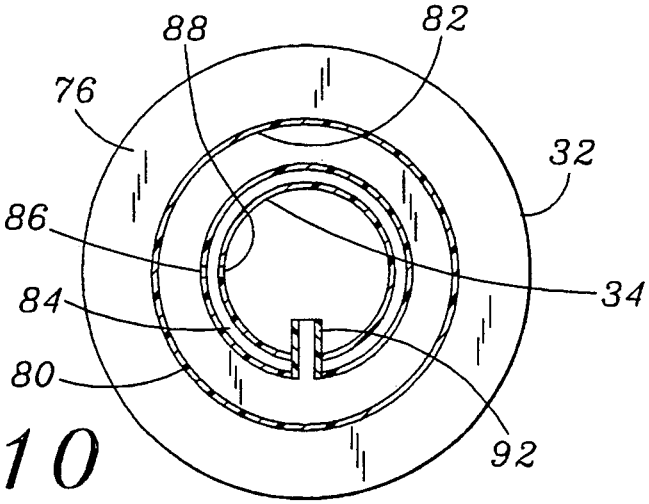
FIG. 10 is a top sectional view of the device of FIG. 9.

In the embodiments heretofore described, the entrainment member 32 is disposed so that the aspiration chamber 36 is essentially coaxial with the high speed gas stream from the nozzle 26. In an embodiment of the invention illustrated in FIGS. 9 and 10, a substantially thinner version of the device 10 results from a reduction in the thickness of the housing 12 by the utilization of an entrainment member 32 consisting of a pair of aligned spaced apart planar annular disks 74 and 76, the central opening of each defining in combination a central aperture 34 for the entrainment member 32. The disks 74 and 76 are spaced apart by raised spacers (not shown) formed on the facing surface of one of the disks 74 or 76 to define an entrainment path 78 between the facing surfaces of the disks. The spaced apart peripheral edges of the disks 74 and 76 provide communication with the interior of the housing 12 about the entire periphery of the entrainment member 32. The inner edge of the disk 74 defining the central aperture is extended back on itself to define a tubular member 80 while the inner edge of the disk 76 extends upwardly to divide the interior of the tubular member 80 into a pneumatic chamber 82 and an aspiration chamber 84 (FIG. 10). Orifices 86 and 88 are provided in the inner wall of the pneumatic chamber 82 and the aspiration chamber 84. The orifices 86 and 88 are aligned for communication from the pneumatic chamber 82 through the aspiration chamber 84 to the central aperture 34 and function as a nozzle in the manner described above. A stem 92 communicates between the pneumatic chamber 82 and a source of pressurized gas (not shown).

The operation of the device 10 is similar to that already described and can be used in the side stream or main stream arrangement. As illustrated, the device is utilized in the main stream arrangement and is connected directly in the carrier gas line 14 for direct flow through of the carrier gas through the interior of the housing 12. Pressurized gas is introduced through the stem 92 to the pneumatic chamber 82 where it creates a high speed stream flowing in both directions through the interior thereof. Liquid to be aspirated is contained in the reservoir in the interior of the housing 12 and responsive to the reduced pressure created in the housing by the high speed stream, is entrained and drawn into the aspiration chamber 84 through the open peripheral edges of the disks 74 and 76 and the entrainment path 78. Aspiration of the liquid occurs in the aspiration chamber 84 essentially at the orifice 86 where the high speed stream passes through the aspiration chamber 84 picking up droplets of the liquid to form an aerosol which ultimately exits through the orifice 88 to the central aperture 34 for dispersion in the carrier gas where it is carried to the patient.

It will be understood that the embodiment of the entrainment member 32 described above utilizes a spaced apart pair of disks, it will be understood that the entrainment member may be a unitary body with entrainment ducts radiating through the body in the manner described in connection with FIGS. 1–8. Likewise the central aperture 34 may be eliminated and replaced with a plurality of openings (not shown) for the passage therethrough of the carrier gas. As mentioned above, the device 10 may be provided with a T-member 16 for utilization in the side stream arrangement.

Other thin-line embodiments of the invention are illustrated in which the entrainment member 32 is defined by a wall of the housing 12 and a corresponding inwardly spaced member. Thus, referring to FIG. 11, where like parts have like function and like reference numbers, the device 10 consists of the housing 12 having opposed walls 37 and 39 and side walls 40. As illustrated, the opposed walls 37 and 39 and the side walls 40 are biased with respect to the horizontal and vertical planes of the device 10 so that regardless of orientation, liquid in the reservoir 13 will tend to collect at the juncture of the side walls 40 and either of the walls 37 and 39 of the housing 12. The housing 12 includes a stem 92 for leading the pressurized gas through the nozzle 26. A baffle 30 is aligned with the outlet of the nozzle bore 28. The entrainment member 32 is defined by the inner face of the front wall 39 and side walls 40 of the housing 12 and an inwardly spaced wall 96 which corresponds to the configuration of the walls 39 and 40 of the housing 12.

Figure 12:
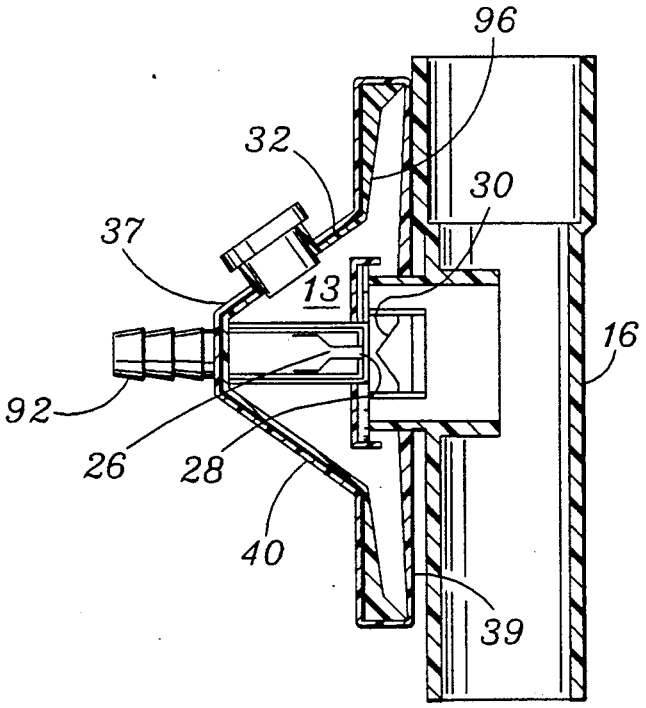
FIG. 12 is a side sectional view of another embodiment of the device of the present invention.

The entrainment member 32 comprises a wall member 114 having an outwardly biased collar 116 about its periphery. The wall member 114 and its collar 116 are spaced from and lie in planes parallel to the wall 37 and the side wall 40 respectively of the housing 12 and a liquid entrainment flow path is defined therebetween. A planer member 118 is disposed in spaced relationship to the wall member 114 and its collar 116 to form a second liquid entrainment flow path therebetween. Both of the entrainment flow paths communicate between the reservoir 13 of the device 10 and the nozzle bore 28 for aspiration of liquid. Regardless of the orientation of the device, liquid in the reservoir will collect at a juncture of either of the walls 37 or 39 and the side wall 40 and is entrained and drawn to the nozzle bore 28 through either entrainment flow path. Referring to FIG. 12, where like parts have like function and like reference numbers, yet another embodiment of the device 10 is illustrated wherein an inwardly spaced wall 96 is provided with a generally bowl shaped configuration to conform with the configuration of the front wall 37 of the housing 12. A liquid entrainment path is formed between the wall 37 and the side wall 40 of the housing 12 and the inwardly spaced wall 96. The device functions in the same manner as described above in connection with FIGS. 3–6.

Figure 11:
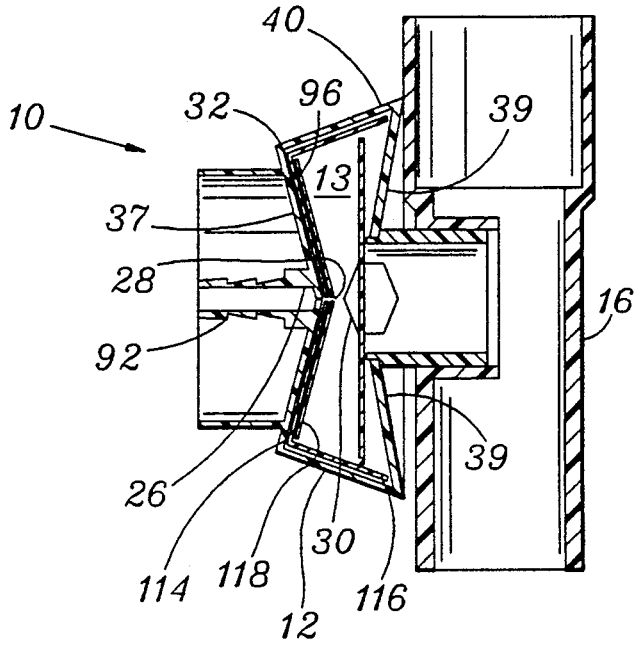
FIG. 11 is a side sectional view of another embodiment of the device of the present invention.

In both the embodiments illustrated in FIGS. 11 and 12, the face of the wall 96 opposing the surface of the wall 39 and the side walls 40, rather than being inwardly spaced from the wall 39, may be provided on its outer surface with open grooves or channels and the wall positioned so that its outer surface is contiguous with the inner surfaces of the walls 39 and 40 of the housing 12 thereby to define closed entrainment ducts 42.

Figure 13:
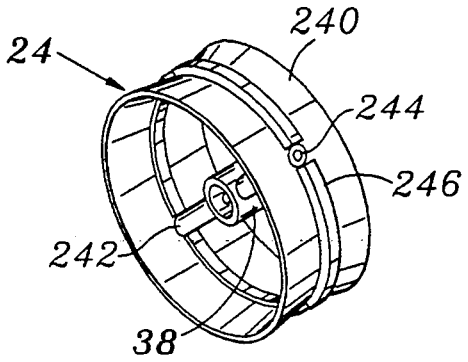
FIG. 13 is a perspective view of another embodiment of an entrainment member of the present invention.
Figure 14:
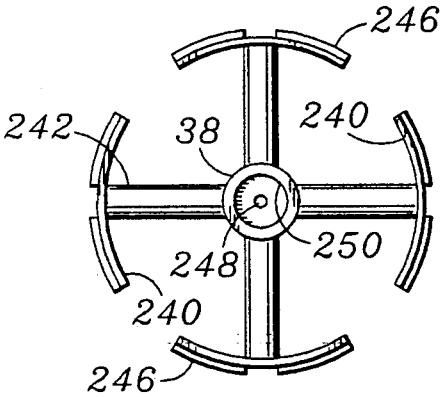
FIG. 14 is a top plan elevation of the entrainment member in accordance with the present invention illustrating a segmented rim.
Figure 15:
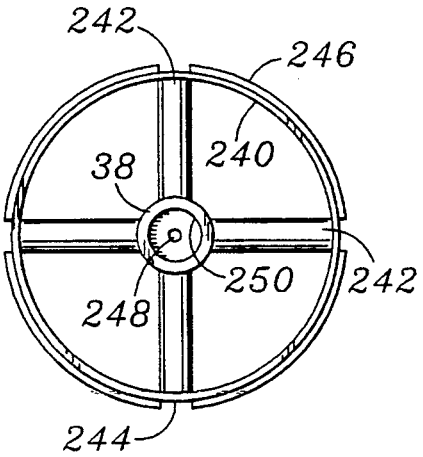
FIG. 15 is a top plan elevation of the entrainment member in accordance with the present invention illustrating a continuous rim.

In the embodiment of the invention illustrated in FIGS. 13, 14 and 15, the entrainment member 32 is an assembly which consists of a hollow central hub 238 and a rim 240 which are interconnected by four hollow arms 242 which radiate equiangularly from the hub 38 and which extend through the rim 240 to define ports 244 for communication to the exterior of the rim 240. A support collar 246 is disposed about the exterior of the rim 240 for supporting the assembly in position within the housing 12. The orifice of the nozzle 30 is received in the interior of the hub 238 and an outlet 248 is disposed in the wall of the hub 238 opposite the nozzle orifice and is aligned therewith. When assembled, the end portion of the nozzle 28 closes the wall of the hub 38 facing the nozzle and an aspiration chamber 50 is defined by the end portion of the nozzle 30 and the walls of the hub 238.

The rim 240 is configured to be received in the interior of the housing 12 with the outer face of the rim 240 spaced slightly inwardly from the interior wall surface of the housing 12 to create a narrow gap therebetween which defines a fluid flow path between the outer face of the rim 240 and the adjacent wall surface of the housing 12. In the embodiment illustrated in FIGS. 13 and 15, the rim 240 is continuous and the fluid flow path extends continuously around the circumference of the interior of the housing 12. As shown in FIG. 14, however, the rim 240 is segmented and the device functions equally as well.

In operation pressurized gas enters the housing 12 through the high-pressure line 18 thence through the bore and orifice of the nozzle 26 to the aspiration chamber 36 defined within the hub 238. The constriction of the stream of pressurized gas produces a high speed stream of gas through the aspiration chamber 36 which creates a high pressure zone in the area immediately adjacent the gas stream and upsets the equilibrium of pressure within the housing resulting low pressure the housing 12 and a higher pressure in the aspiration chamber 36. Liquid is thus drawn to the aspiration chamber 36 through the fluid flow path defined by the space between the surface of the rim 240 and the walls of the housing 12, the ports 44 and the hollow arms 42 where it is aspirated and carried away in the high speed gas stream as previously described. The aspirated liquid exits the aspiration chamber 36 through the outlet 248 in the hub 238.

As will be understood by those skilled in the art, various arrangements other than those described in detail in this specification, will occur to those persons skilled in the art which arrangements lie within the spirit and scope of the invention. It is therefore to be understood that the invention is to be limited only by the claims appended hereto.

I claim:

1. In a device for aspirating a liquid comprising a hollow housing having end walls and side walls and defining a reservoir for a liquid to be aspirated, said housing having inlet means for a carrier gas and a pressurized gas, and an outlet for said carrier gas and aspirated fluid, nozzle means within said housing communicating with said inlet means for said pressurized gas and communicating with said reservoir for producing reduced pressure within said housing and for aspirating said liquid, the improvement comprising:

an entrainment member disposed in said housing and capable of conveying liquid in said reservoir to said nozzle means for aspiration irrespective of the position and orientation of said device, said entrainment member defining a peripheral surface spaced from said housing side walls and disposed parallel thereto to provide a flow path for fluid communication between said peripheral surface and said reservoir and means providing fluid communication between said peripheral surface and said nozzle means, whereby liquid in said reservoir is entrained in said flow path and is drawn to said nozzle outlet for aspiration due to the reduced pressure in said housing caused by a stream of gas exiting said nozzle irrespective of the position and orientation of said device.

2. The device of claim 1 wherein said entrainment member has a central aperture in communication with the orifice of said nozzle to define an aspiration chamber and said flow paths communicate between said aspiration chamber and said peripheral edges of said entrainment member.

3. The device of claim 2 wherein said entrainment member consists of a planar body having a plurality of spaced apart channels which extend through the body of said entrainment member and which radiate outwardly in a 360° pattern from said aspiration chamber to said peripheral edges of said entrainment member.

4. The device of claim 3 wherein said spaced apart channels open at said peripheral edges and at said aspiration chamber of said entrainment member to define entrainment ports.

5. The device of claim 1 wherein said edges of said entrainment member are extended normal to said first and said second walls to define a collar about said entrainment member, said collar having an outer surface which is spaced away from said inner wall of said housing and cooperating therewith to define said flow path between said edges and said housing inner wall.

6. The device of claim 1 wherein said entrainment member comprises a spaced apart pair of planer members lying in parallel planes, the space therebetween comprising a multiplicity of liquid flow paths whereby entrained liquid is drawn to said nozzle from any direction in said reservoir.

7. The device of claim 1 wherein said edges of said entrainment member are configured to define an annular collar having an inner face and an outer face, said outer face being spaced inwardly from said side wall of said housing to provide a fluid entrainment passage about the periphery of said entrainment member opening into said reservoir for communication between said flow paths in said entrainment member and said reservoir, said inner face of said collar being biased away from said entrainment member so that liquid in said reservoir is directed towards the opening of said fluid entrainment passage.

8. The device of claim 1 wherein said device is adapted for connection in a side stream arrangement with a carrier gas line by a T-member which provides communication between said interior of said housing and the carrier gas line.

9. The device of claim 1 wherein said device is adapted for in-line attachment with a carrier gas line and said carrier gas flows through a carrier gas conduit extending through said housing interior, said entrainment member being adapted for the extension therethrough of said carrier gas conduit whereby said carrier gas is isolated from the interior of said housing.

10. The device of claim 1 wherein said entrainment member is disposed in said housing with a surface proximate to and lying in a plane parallel to an end wall of said housing, said entrainment member spaced therefrom to define a multiplicity of liquid flow paths between said entrainment member and said housing end wall.

11. The device of claim 11 wherein said entrainment member is disposed with a surface contiguous with an end wall of said housing, said contiguous surface having thereon a plurality of open channels radiating from essentially the center of said entrainment member to its periphery, whereby each of said channels are closed by the surface of said end wall.

12. The device of claim 1 wherein said entrainment member comprises a pair of annular disks aligned and spaced apart to define a central aperture and an entrainment path between facing surfaces of the disks, said entrainment path opening to said reservoir at the periphery of said disks, a tubular member disposed about said central aperture on a surface of one of said disks opposite its facing surface, said tubular member further including an internal wall dividing the interior thereof into a pneumatic chamber and an aspiration chamber, said chambers being coaxially disposed with respect to said central aperture and said aspiration chamber being located adjacent said central aperture and said pneumatic chamber communicating with a source of pressurized gas, nozzle means communicating between said pneumatic chamber and said aspiration chamber and outlet means communicating between said aspiration chamber and said central aperture.

13. The device of claim 1 wherein said entrainment member comprises a wall member having an outwardly biased collar about its periphery, said wall member and said collar being spaced from and lying in planes parallel to said end wall and said side wall respectively to define a liquid entrainment flow path therebetween, a second planer member being disposed in spaced relationship to said wall member and said collar to form a second liquid entrainment flow path therebetween, both said first and said second entrainment flow paths providing communication between said reservoir and said nozzle bore.

14. The device of claim 1 wherein said entrainment member comprises a central hollow hub defining an aspiration chamber, an outer rim defining an exterior wall surface configured to fit in said housing adjacent the inner surface of said side walls thereof to define a fluid path therebetween, and at least a pair of opposed hollow arms extending between said central hollow hub and said rim, said hollow arms communicating between the interior of said hollow hub and the exterior of said rim to define a fluid flow path from said rim 10 to said central hub interior, said nozzle extending into said hollow hub for discharging a stream of pressurized gas therein, an opening being provided in said hub opposite said nozzle to provide an outlet for discharging gas and aspirated liquid from the hub.

15. The device of claim 14 wherein said rim describes an annulus extending 360° about said central hub, said rim having an opening for receiving the end of each of said hollow arms.

16. The device of claim 14 wherein said entrainment member comprises said hollow central hub and said rim interconnected by four hollow arms which radiate equiangularly from said hub, the outer end of each said hollow arm extending through said rim for communication between the interior of said central hub and the exterior of said rim.

17. The device of claim 14 wherein said rim is segmented and the outer end of each of said hollow arms carries a corresponding segment, each said rim segment defining an exterior wall surface configured to fit in said housing adjacent the inner surface of said side walls thereof to define a fluid path therebetween and said hollow arm opens to said exterior surface of said rim segment for fluid communication between the interior of said hollow hub and the exterior surface of said rim segment.

18. The device of claim 1 wherein said end walls of said housing have inner surfaces biased to describe a shallow cone.

* * * * *